US008480258B2

(12) United States Patent
Chen

(10) Patent No.: US 8,480,258 B2
(45) Date of Patent: Jul. 9, 2013

(54) ROTATION ANGLE REGULATING DEVICE AND ROTATABLE LAMP USING THE SAME

(75) Inventor: Sheng-Ping Chen, Kaohsiung (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 13/544,481

(22) Filed: Jul. 9, 2012

(65) Prior Publication Data

US 2013/0100687 A1 Apr. 25, 2013

(30) Foreign Application Priority Data

Oct. 24, 2011 (TW) ..... 100138545 A

(51) Int. Cl.
*F21V 9/00* (2006.01)

(52) U.S. Cl.
USPC ..... 362/269; 362/282; 362/545; 315/118; 315/291

(58) Field of Classification Search
CPC .. F21V 9/00; F21V 21/14; F21V 33/076; F21S 10/06
USPC ..... 362/269, 282, 249.02–249.03; 315/118, 315/291
See application file for complete search history.

(56) References Cited

U.S. PATENT DOCUMENTS

| | | | | |
|---|---|---|---|---|
| 7,775,691 | B2 * | 8/2010 | Burgei et al. | 362/386 |
| 7,791,497 | B2 * | 9/2010 | Clerk | 340/815.4 |
| 8,201,974 | B1 * | 6/2012 | Smith et al. | 362/257 |
| 8,403,509 | B2 * | 3/2013 | Chin et al. | 362/35 |
| 2002/0114161 | A1 * | 8/2002 | Barnett | 362/282 |

FOREIGN PATENT DOCUMENTS

TW M348979 1/2009

OTHER PUBLICATIONS

English language translation of abstract of TW M348979 (published Jan. 11, 2009).

* cited by examiner

*Primary Examiner* — Tracie Y Green
(74) *Attorney, Agent, or Firm* — McClure, Qualey & Rodack, LLP

(57) ABSTRACT

A rotation angle regulating device and a rotatable lamp using the same are provided. Through N passive rotating elements used for regulating the rotation angle, the rotation angle of the active rotating element relative to the fixing element is increased, wherein N is a positive integral equal to or more than 1. In addition, each passive rotating element has a first stopper and a second stopper. The active rotating element, when rotating, drives and makes the passive rotating elements rotating on the fixing element, so that the rotation of the lamp can be stopped at any designated angle through the operations of the first and second stoppers of each passive rotating element.

11 Claims, 6 Drawing Sheets

ROTATION ANGLE REGULATING DEVICE AND ROTATABLE LAMP USING THE SAME

This application claims the benefit of Taiwan application Serial No. 100138545, filed Oct. 24, 2011, the subject matter of which is incorporated herein by reference.

BACKGROUND OF THE INVENTION

1. Field of the Invention

The invention relates in general to a rotating device, and more particularly to a rotation angle regulating device and a rotatable lamp using the same.

2. Description of the Related Art

Ordinary illumination lamps, such as fluorescent lamps, art lamps, advertising lights, and projection lamps have a large variety of models and styles. However, once a lamp is installed, the illumination angle and range are fixed and can hardly be changed. Also, once the tubes or bulbs are manufactured, the types and purposes of the tubes or bulbs are fixed and cannot be replaced with other ones. It seems that the lamp do not have any functions other than illumination.

Despite that a lamp may have a rotation angle regulating device, the rotation angle of the lamp is limitary. For example, the rotation angle is smaller than 270 degrees. Once the default maximum rotation angle is reached, the rotation of the lamp is stopped through the design of a stopper structure. Therefore, the lamp still has many restrictions in terms of use, and needs to be improved further.

SUMMARY OF THE INVENTION

The invention is directed to a rotation angle regulating device and a rotatable lamp using the same. The lamp can be rotated to an angle over 360 degrees and may be stopped at a designated angle.

According to one embodiment of the present invention, a rotation angle regulating device comprising a fixing element, an active rotating element and N passive rotating elements are provided. N is a positive integral equal to or more than 1. The fixing element has a first axis hole with a positioning flange disposed around the periphery of the first axis hole. The active rotating element has a second axis hole with a bump disposed around the periphery of the second axis hole. The N passive rotating elements are located between the fixing element and the active rotating element. Each passive rotating element has a through hole, and a first stopper and a second stopper are respectively disposed around the periphery of the through hole on two opposite sides of the through hole. The positioning flange is located on the rotation path of the first stopper of the first passive rotating element. The bump is located on the rotation path of the second stopper of the N-th passive rotating element. The first and the second stoppers of the j-th passive rotating element respectively press against the second and the first stoppers which are located on the i-th and the k-th passive rotating elements adjacent to the j-th passive rotating element, wherein $1 \leqq i < j < k \leqq N$, i, j, and k are positive integrals. The passive rotating elements respectively press against the fixing element and the active rotating element through the first passive rotating element and the N-th passive rotating element. The active rotating element, when rotating, drives and makes the passive rotating elements rotating on the fixing element. Consequently, the rotation angle of the active rotating element relative to the fixing element is increased, and the rotation of the lamp may be stopped at any designated angle through the operations of the first and the second stoppers of each passive rotating element.

According to another embodiment of the present invention, a rotatable lamp comprising a frame, a lamp, a first rotation angle regulating device and a second rotation angle regulating device is provided. The frame defines an illumination region within which the lamp is disposed. The first and the second rotation angle regulating devices are respectively fixed at a first position and a second position on the sidewall of the lamp. The first and the second positions are symmetric with each other on the lamp. The first and the second rotation angle regulating devices respectively correspond to first and second corresponding portions of the frame, such that the irradiation angle of the lamp is controlled by the first and the second rotation angle regulating devices to be fixed at a designated angle.

The above and other aspects of the invention will become better understood with regard to the following detailed description of the preferred but non-limiting embodiment(s). The following description is made with reference to the accompanying drawings.

DETAILED DESCRIPTION OF THE INVENTION

A rotation angle regulating device and a rotatable lamp using the same are disclosed in the present embodiment. Through the passive rotating elements capable of regulating the rotation angle, the rotation angle of the active rotating element relative to the fixing element is increased. In addition, each passive rotating element has a first stopper and a second stopper. The active rotating element, when rotating, drives and makes the passive rotating elements rotating on the fixing element, so that the rotation of the lamp can be stopped at any designated angle through the operations of the first and second stoppers of each passive rotating element.

Suppose the rotation angle regulating device has N passive rotating elements, wherein N is a positive integral equal to or more than 1. When two or more than two passive rotating elements are used, the first and the last passive rotating elements respectively press against the fixing element and the active rotating element, and the first and the second stoppers of the j-th passive rotating element respectively press against the second and the first stoppers of the i-th and the k-th passive rotating elements adjacent to the j-th passive rotating element, wherein $1 \leqq i < j < k \leqq N$, i, j, and k are positive integrals. Suppose the rotation angle regulating device has M second passive rotating elements, wherein M is a positive integral equal to or more than 1. The first and the last of the second passive rotating elements respectively press against another fixing element and another active rotating element. The third and the fourth stoppers of the q-th of the second passive rotating elements respectively press against the fourth and the third stoppers of the p-th and the r-th of the second passive rotating elements adjacent to the q-th of the second passive rotating elements, wherein $1 \leqq p < q < r \leqq M$, p, q, and r are positive integrals. A number of embodiments are disclosed below for elaborating the invention. However, the embodiments of the invention are for detailed descriptions only, not for limiting the scope of protection of the invention.

First Embodiment

Figure 1:
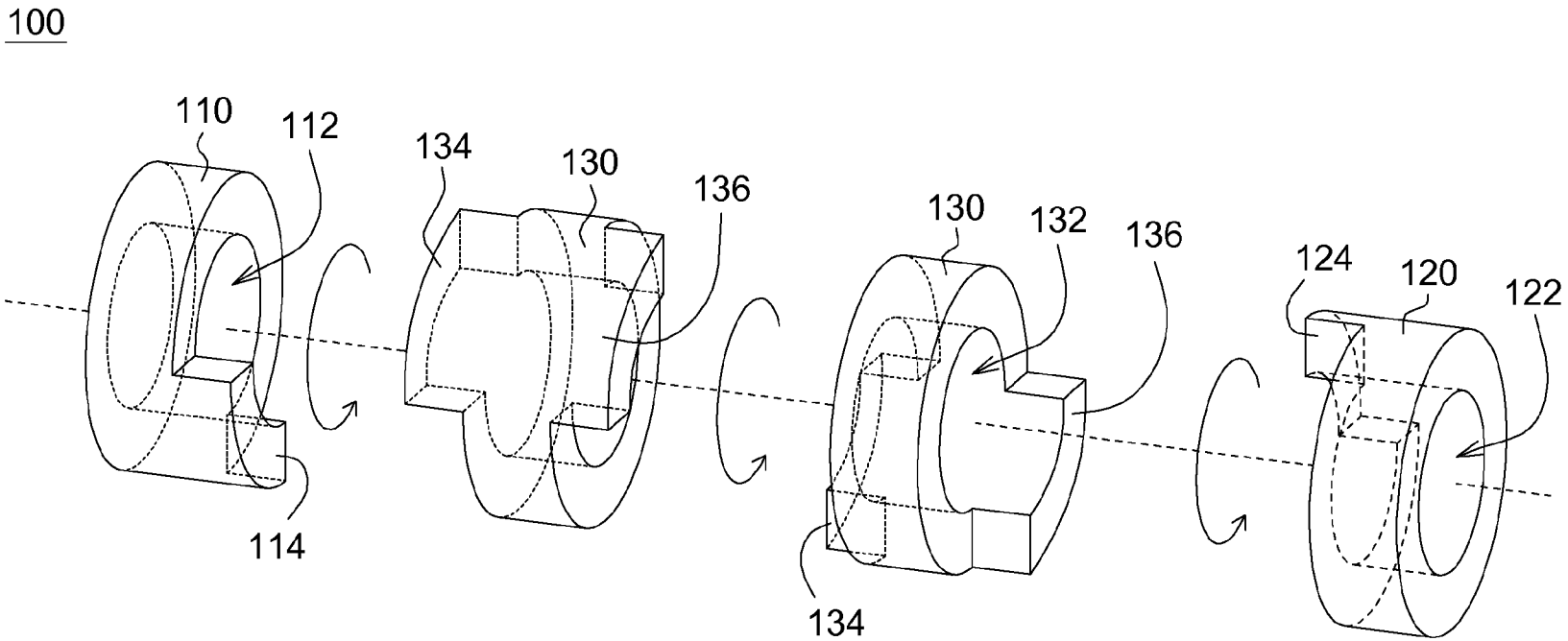
FIG. 1 shows a decomposition diagram of a rotation angle regulating device according to one embodiment of the invention.

Referring to FIG. 1, a decomposition diagram of a rotation angle regulating device according to one embodiment of the invention is shown. The rotation angle regulating device 100 comprises a fixing element 110, an active rotating element 120 and N passive rotating elements 130. N is a positive integral equal to or more than 1. In the present embodiment, two passive rotating elements 130 are used as an exemplification. The fixing element 110 has a first axis hole 112 with a positioning flange 114 disposed around the periphery of the first axis hole. The active rotating element 120 has a second axis hole 122 with a bump 124 disposed around the periphery of the second axis hole. The passive rotating elements 130 are located between the fixing element 110 and the active rotating element 120. Each passive rotating element 130 has a through hole 132. A first stopper 134 and a second stopper 136 are respectively disposed around the periphery on two opposite sides of the through hole 132. The positioning flange 114 is located on the rotation path of the first stopper 134 of the first passive rotating element 130. The bump 124 is located on the rotation path of the second stopper 136 of the second passive rotating element 130. The first passive rotating element 130 and the second passive rotating element 130 respectively press against the fixing element 110 and the active rotating element 120. The active rotating element 120, when rotating, drives and makes the two passive rotating elements 130 rotating on the fixing element 110. Consequently, the rotation angle of the active rotating element 120 relative to the fixing element 110 is increased, and the rotation of the lamp can be stopped at any designated angle through the operations of the first and the second stoppers 134 and 136 of each passive rotating element 130.

Second Embodiment

Figure 2A:
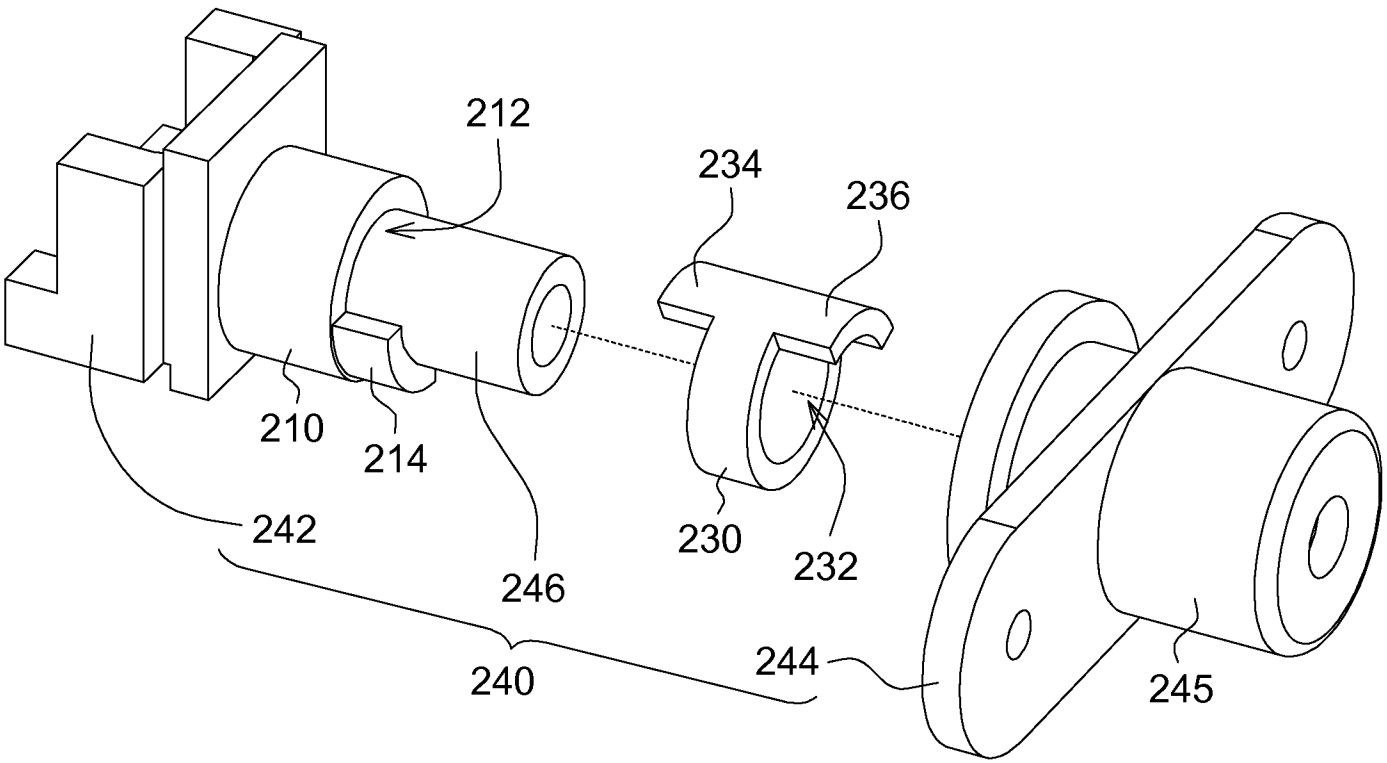
FIG. 2A shows a decomposition diagram of a rotation angle regulating device according to one embodiment of the invention.
Figure 2B:
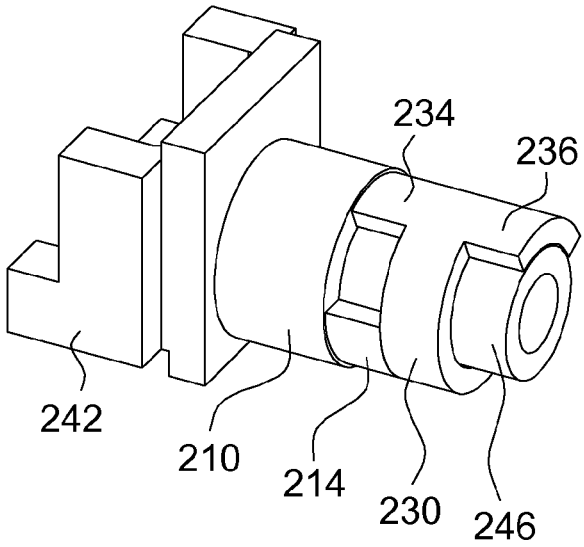
FIGS. 2B and 2C respectively are a partial assembly diagram of the rotation angle regulating device of FIG. 2A.
Figure 2C:
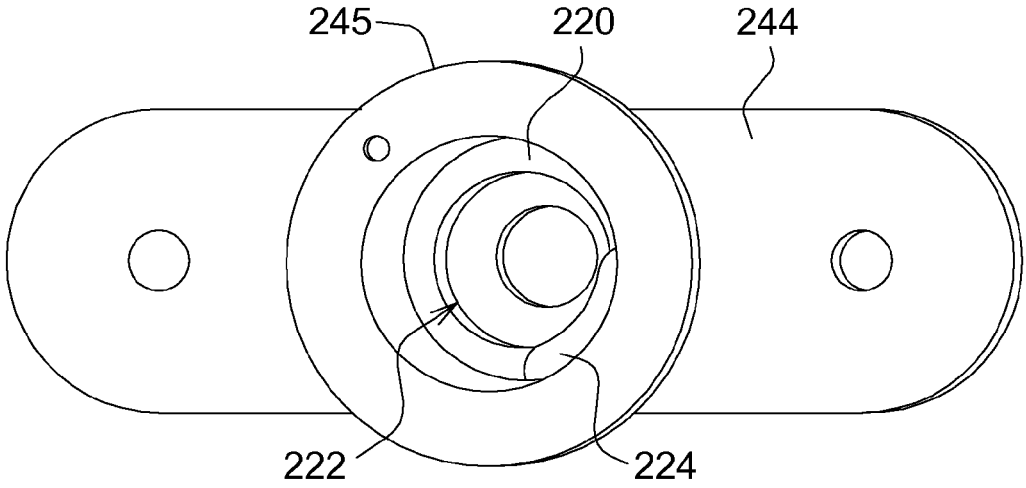
Figure 2D:
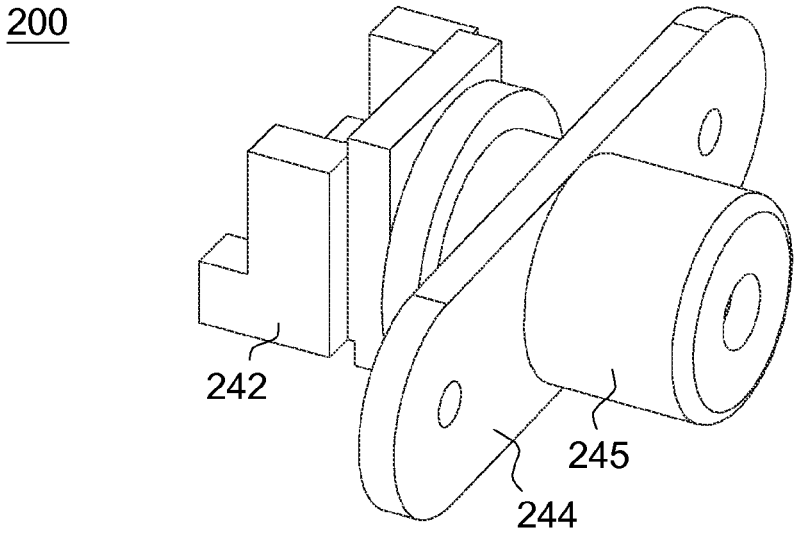
FIG. 2D is a schematic diagram of the rotation angle regulating device of FIG. 2A.

Referring to FIGS. 2A~2D. FIG. 2A shows a decomposition diagram of a rotation angle regulating device according to one embodiment of the invention. FIG. 2B is a partial assembly diagram of the rotation angle regulating device of FIG. 2A. FIG. 2C is another partial assembly diagram of the rotation angle regulating device of FIG. 2A, and shows the integration of an active rotating element and a second fixing base. FIG. 2D is a complete assembly diagram of the rotation angle regulating device of FIG. 2A.

As shown in FIG. 2A, the rotation angle regulating device 200 comprises a fixing element 210, an active rotating element 220, N passive rotating elements 230 and a pivoting device 240. N is a positive integral equal to or more than 1. The pivoting device 240 comprises a first fixing base 242, a second fixing base 244, and a pivot 246. Preferably, the pivoting device 240 connects the fixing element 210, the passive rotating element 230, and the active rotating element 220 to be on the same axis.

In the present embodiment, one passive rotating element 230 is used as an exemplification. The fixing element 210 has a first axis hole 212 with a positioning flange 214 disposed around the periphery of the first axis hole 212. The passive rotating element 230 has a through hole 232, and a first stopper 234 and a second stopper 236 are respectively disposed around the periphery on two opposite sides of the through hole 232. The active rotating element 220 has a second axis hole 222 with a bump 224 disposed around the periphery of the second axis hole. As shown in FIG. 2C, the active rotating element 220 and the second fixing base 244 are combined and preferably are integrated in one piece. The second fixing base 244 has a sleeve 245. The first fixing base 242 is for fixing the fixing element 210. The second fixing base 244 is for fixing the active rotating element 220. The pivot 246, disposed on the first fixing base 242, passes through the first axis hole 212 of the fixing element 210, the through hole 232 of the passive rotating element 230, and the sleeve 245 of the second fixing base 244 to press against the second axis hole 222 of the active rotating element 220.

As shown in FIG. 2B, the pivot 246 extends along the axial direction from the first fixing base 242 and passes through the first axis hole 212 of the fixing element 210 and the through hole 232 of the passive rotating element 230, such that the fixing element 210 and the passive rotating element 230 can be fixed on the first fixing base 242. One side of the passive rotating element 230 presses against the fixing element 210. The positioning flange 214 is located on the rotation path of the first stopper 234 of the passive rotating element 230. Unless the first stopper 234 is rotated to the angular orientation of the positioning flange 214 and is then forced to stop, otherwise the passive rotating element 230 can rotate freely.

Referring to FIG. 2B and FIG. 2C at the same time. The pivot 246 passes through the sleeve 245 of the second fixing base 244 and presses against the second axis hole 222 of the active rotating element 220. The other side of the passive rotating element 230 presses against the active rotating element 220. Then, the assembly of the rotation angle regulating device 200 as shown in FIG. 2D is completed. As shown in FIG. 2D, the fixing element 210, the passive rotating element 230, and the pivot 246 are disposed inside the sleeve 245. In addition, the bump 224 is located on the rotation path of the second stopper 236 of the passive rotating element 230. Unless the bump 224 is rotated to the angular orientation of the second stopper 236 and presses against the second stopper 236 and further drives the first stopper 234 to be rotated to the angular orientation of the positioning flange 214 and is then forced to stop, otherwise the active rotating element 220 can rotate freely.

When the active rotating element 220 rotates, the bump 224 drives and makes the passive rotating element 230 rotating on the fixing element 210, such that the rotation angle of the active rotating element 220 relative to the fixing element 210 is increased. Suppose the maximum rotation angle of the active rotating element 220 relative to the passive rotating element 230 is $\theta 1$ and the maximum rotation angle of the passive rotating element 230 relative to the fixing element 210 is $\theta 2$. Then, the maximum rotation angle of the active rotating element 220 relative to the fixing element 210 is equal to $\theta 1+\theta 2$.

Suppose there are N passive rotating elements 230 located between the active rotating element 220 and the fixing element 210, and the maximum rotation angle between two neighboring passive rotating elements 230 is $\theta 3$. Then, the maximum rotation angle of the active rotating element 220 relative to the fixing element 210 is equal to $\theta 1+\theta 2+(N-1)\theta 3$. By the same analogy, the rotation angle of the active rotating element 220 relative to the fixing element 210 is equal to the sum of relative rotation angles between the fixing element 210, the passive rotating elements 230 and the active rotating element 220.

Thus, through the first stopper 234 and the second stopper 236 of the passive rotating element 230, the rotation of the lamp can be stopped at any designated angle. Furthermore, the lamp can achieve a larger rotation angle such as over 360 degrees. Through the increase in the quantity of the passive rotating elements 230, the rotation angle of the active rotating element 220 relative to the fixing element 210 is increased.

A practical embodiment of using the rotation angle regulating device in a rotatable lamp is disclosed below.

Figure 3:
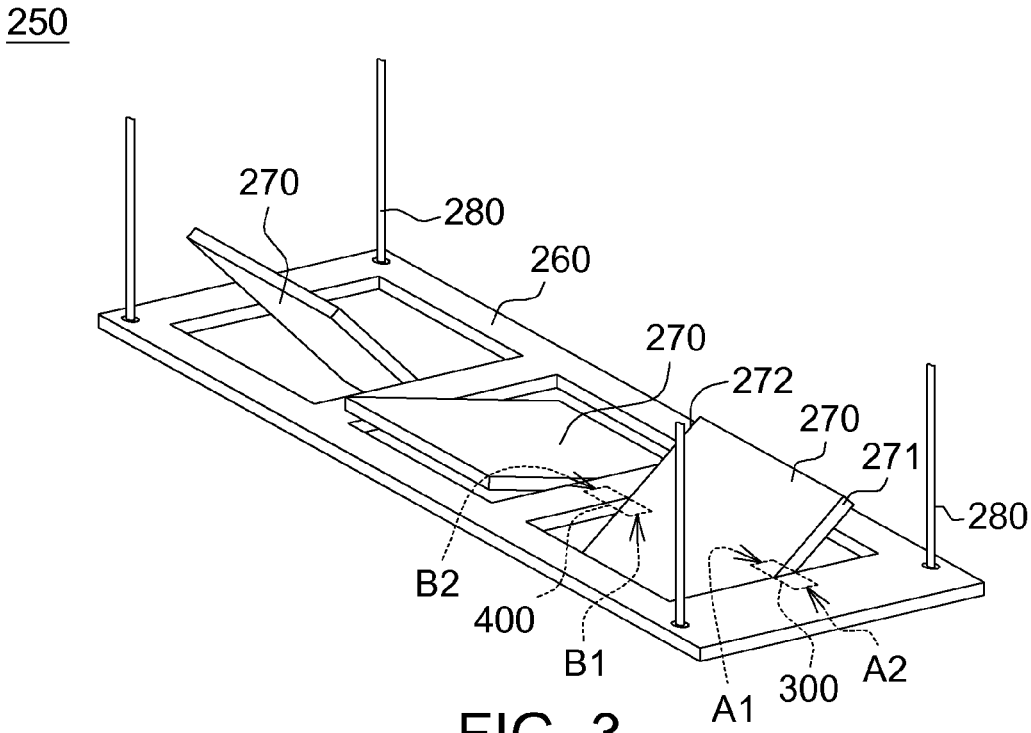
FIG. 3 shows a schematic diagram of a rotatable lamp according to one embodiment of the invention.

Referring to FIG. 3, a schematic diagram of a rotatable lamp according to one embodiment of the invention is shown. The rotatable lamp 250 comprises a frame 260, a lamp 270, a first rotation angle regulating device 300 and a second rotation angle regulating device 400. The frame 260 defines an illumination region. In the present embodiment, the size and position of the illumination region can be adjusted according to actual needs. The lamp 270 is disposed within the illumination region of the frame 260 for providing necessary illumination. The frame 260, which can be hanged in the air through a spreader 280, can be realized by a polygon, a rectangle, a circle, or an ellipse or other geometric shape, and the invention does not restrict the shape of the fame.

The first rotation angle regulating device 300 is fixed at a first position A1 on the sidewall 271 of the lamp 270 and at the first corresponding portion A2 of the frame 260. The second rotation angle regulating device 400 is fixed at a second position B1 on the sidewall 272 of the lamp 270 and fixed on the second corresponding portion B2 of the frame 260. The first position A1 and the second position B1 are symmetric with each other on the lamp 270. The first and the second positions A1 and B1 respectively correspond to the first and the second corresponding portions A2 and B2 of the frame 260, such that the irradiation angle of the lamp 270 can be controlled by the first and the second rotation angle regulating devices 300 and 400 to be fixed at a designated angle. In the present embodiment, three lamps 270, controlled by the first and the second rotation angle regulating devices 300 and 400, can change respective illumination angle and provide light sources in different illumination directions or for situational illumination.

Figure 4A:
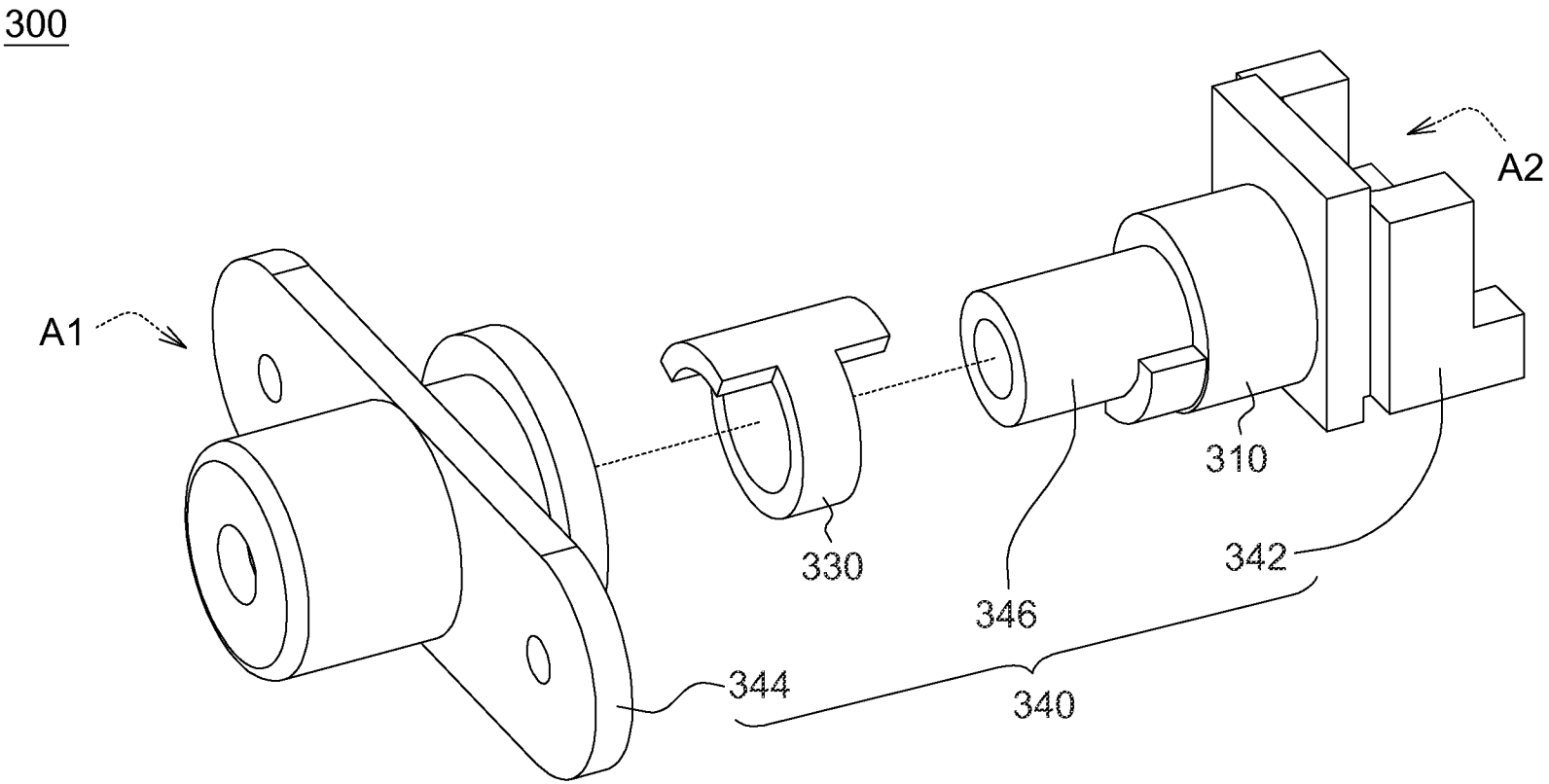
FIGS. 4A and 4B are enlarged diagrams of the first and the second rotation angle regulating devices of FIG. 3.
Figure 4B:
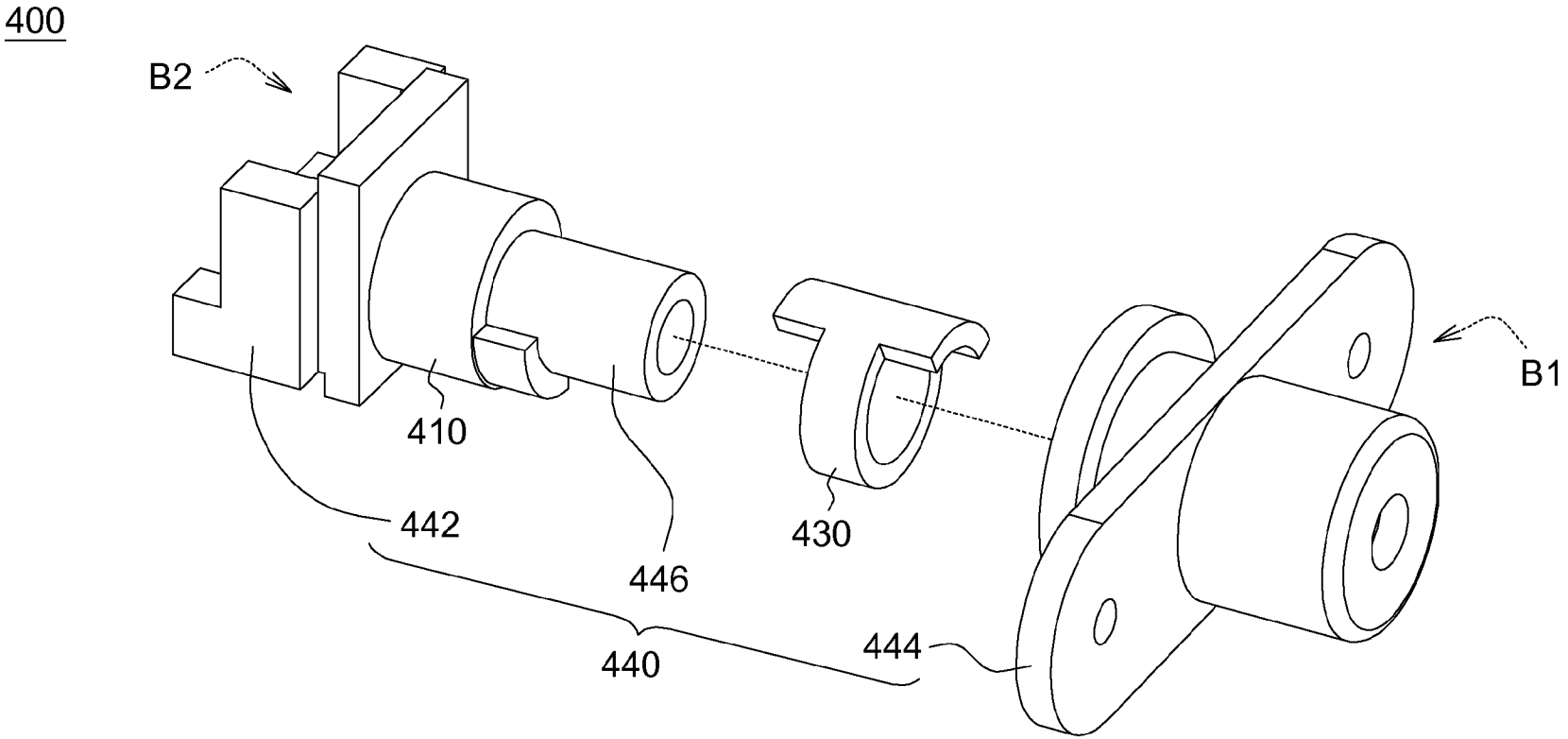

Referring to FIGS. 4A and 4B, enlarged diagrams of the first and the second rotation angle regulating devices of FIG. 3 are sown. As shown in FIG. 4A, the first rotation angle regulating device 300 comprises a first fixing element 310, a first active rotating element 320, N first passive rotating elements 330, and a first pivoting device 340. N is a positive integral equal to or more than 1. The first fixing element 310 is fixed on the first corresponding portion A2 of the frame 260. The first active rotating element 320 is fixed at the first position A1 on the sidewall of the lamp 270. Detailed structures of the first fixing element 310, the first active rotating element 320, the first passive rotating elements 330, a first pivoting device 340 are similar to that of the rotation angle regulating device 200 of FIGS. 2A-2D. Detailed descriptions are disclosed in the second embodiment and FIGS. 2A-2D, and are not repeated here. Similarly, the second rotation angle regulating device 400 comprises a second fixing element 410, a second active rotating element 420, M second passive rotating elements 430, and a second pivoting device 440. M is a positive integral equal to or more than 1. The second fixing element 410 is fixed on the second corresponding portion B2 of the frame 260. The second active rotating element 420 is fixed at the second position B1 on the sidewall of the lamp 270. Detailed structures of the second fixing element 410, the second active rotating element 420, the second passive rotating elements 430, the second pivoting device 440 are similar to that of the rotation angle regulating device 200 of FIGS. 2A-2D. Detailed descriptions are disclosed in the second embodiment and FIGS. 2A-2D, and are not repeated here.

The quantities of the first and the second passive rotating elements of FIGS. 4A and 4B are exemplified by 1. However, the invention is not limited to the above exemplification and the quantities of the first and the second passive rotating elements can be increased according to actual needs to increase the rotation angle of the active rotating element relative to the fixing element.

As shown in FIGS. 4A and 4B, the first pivoting device 340 and the second pivoting device 440 are disposed between corresponding positions of the frame 260 and the lamp 270 respectively. The first pivoting device 340 comprises a first fixing base 342 and a second fixing base 344. The first fixing base 342 is fixed on the first corresponding portion A2 of the frame 260. The first fixing base 342 includes a first pivot 346, which extends towards the first position A1 from the first fixing base 342. In addition, the second fixing base 344 is fixed at the first position A1 on the sidewall of the lamp 270, and the first active rotating element 320 is fixed on the second fixing base 344.

The second pivoting device 440 comprises a third fixing base 442 and a fourth fixing base 444. The third fixing base 442 is fixed on the second corresponding portion B2 of the frame 260. The third fixing base 442 includes a second pivot 446, which extends towards the second position B1 from the third fixing base 442. In addition, the fourth fixing base 444 is fixed at the second position B1 on the sidewall of the lamp 270, and the second active rotating element 420 is fixed on the fourth fixing base 444.

Thus, through the first and the second rotation angle regulating devices 300 and 400, the lamp 270 can rotate on the frame 260, and the illumination angle of the lamp 270 can be adjusted and fixed at a designated angle.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A rotation angle regulating device, comprising:

a fixing element having a first axis hole with a positioning flange disposed around the periphery of the first axis hole;

an active rotating element having a second axis hole with a bump disposed around the periphery of the second axis hole; and N passive rotating elements located between the fixing element and the active rotating element, wherein N is a positive integral equal to or more than 1, each passive rotating element has a through hole, a first stopper and a second stopper are respectively disposed around the periphery on two opposite sides of the through hole, the positioning flange is located on a rotation path of the first stopper of the first passive rotating element, the bump is located on a rotation path of the second stopper of the N-th passive rotating element, the first and the second stoppers of the j-th passive rotating element respectively press against the second and the first stoppers which are located on the i-th and the k-th passive rotating elements adjacent to the j-th passive rotating element, and $1 \leqq i < j < k \leqq N$, i, j, and k are positive integrals;

wherein, the passive rotating elements respectively press against the fixing element and the active rotating element through the first passive rotating element and the N-th passive rotating element, and the active rotating element, when rotating, drives and makes the passive rotating elements rotating on the fixing element, such that a rotation angle of the active rotating element relative to the fixing element is increased, and the rotation is stopped at any designated angle through the operations of the first and the second stoppers of each passive rotating element.

2. The device according to claim 1, further comprising a pivoting device for fixing the fixing element, the active rotating element and the passive rotating elements, wherein the pivoting device comprises:

a first fixing base for fixing the fixing element;

a second fixing base for fixing the active rotating element, wherein the second fixing base has a sleeve; and a pivot disposed on the first fixing base, wherein the pivot passes through the first axis hole of the fixing element, the through hole of each passive rotating element and the sleeve of the second fixing base to press against the second axis hole of the active rotating element.

3. The device according to claim 1, wherein the rotation angle of the active rotating element relative to the fixing element is equal to a sum of relative rotation angles between the fixing element, the passive rotating elements and the active rotating element.

4. A rotatable lamp, comprising:

a frame which defines an illumination region;

a lamp disposed within the illumination region defined by the frame; and a first rotation angle regulating device and a second rotation angle respectively fixed at a first position and a second position on the sidewall of the lamp, wherein the first and the second positions are symmetric with each other on the lamp, and the first and the second rotation angle regulating devices respectively correspond to the first and the second corresponding portions of the frame, such that the irradiation angle of the lamp is controlled by the first and the second rotation angle regulating devices to be fixed at a designated angle.

5. The rotatable lamp according to claim 4, wherein the first rotation angle regulating device comprises:

a first fixing element fixed at the first corresponding portion of the frame, wherein the first fixing element has a first axis hole with a first positioning flange disposed around the periphery of the first axis hole;

a first active rotating element fixed at the first position on the sidewall of the lamp, wherein the first active rotating element has a second axis hole with a first bump disposed around the periphery of the second axis hole; and N first passive rotating elements located between the first fixing element and the first active rotating element, wherein N is a positive integral equal to or more than 1, each first passive rotating element has a first through hole, a first stopper and a second stopper are respectively disposed around the periphery on two opposite sides of the first through hole, the first positioning flange is located on a rotation path of the first stopper of the first one of the first passive rotating elements, the first bump is located on a rotation path of the second stopper of the N-th of the first passive elements, the first and the second stoppers of the j-th of the first passive rotating elements respectively press against the second and the first stoppers which are located on the i-th and the k-th passive rotating elements adjacent to the j-th passive rotating element, and $1 \leqq i < j < k \leqq N$, i, j, and k are positive integrals;

wherein, the first passive rotating elements respectively press against the first fixing element and the first active rotating element through the first and the N-th of the first passive elements, and the first active rotating element, when rotating, drives and makes the first passive rotating elements rotating on the first fixing element, such that a rotation angle of the first active rotating element relative to the first fixing element is increased, and the rotation of the lamp is stopped at any designated angle through the operations of the first and the second stoppers of each first passive rotating element.

6. The rotatable lamp according to claim 4, wherein the second rotation angle regulating device comprises:

a second fixing element is fixed at the second corresponding portion of the frame, wherein the second fixing element has a third axis hole with a second positioning flange disposed around the periphery of the third axis hole;

a second active rotating element is fixed at the second position of the sidewall of the lamp, wherein the second active rotating element has a fourth axis hole with a second bump disposed around the periphery of the fourth axis hole; and M second passive rotating elements located between the second fixing element and the second active rotating element, wherein M is a positive integral equal to or more than 1, each second passive rotating element has a second through hole, a third stopper and a fourth stopper are respectively disposed around the periphery on two opposite sides of the second through hole, the second positioning flange is located on a rotation path of the third stopper of the first one of the second passive rotating elements, the second bump is located on a rotation path of the fourth stopper of the N-th of the second passive rotating elements, the third and the fourth stoppers of the q-th of the second passive rotating elements respectively press against the fourth stopper and the third stopper of the p-th and the r-th of the second passive rotating elements at the two sides of the q-th passive rotating element, and $1 \leqq p < q < r \leqq M$, p, q, and r are positive integrals;

wherein, the second passive rotating elements respectively press against the second fixing element and the second active rotating element through the first and the M-th of the second passive rotating elements, and the second active rotating element, when rotating, drives and makes the second passive rotating elements rotating on the second fixing element, such that a rotation angle of the second active rotating element relative to the second fixing element is increased, and the rotation of the lamp is stopped at any designated angle through the operations of the third and the fourth stoppers of each second passive rotating element.

7. The rotatable lamp according to claim 5, further comprising a first pivoting device for fixing the first fixing element, the first active rotating element and the first passive rotating elements, wherein the first pivoting device comprises:

a first fixing base fixed at the first corresponding portion of the frame, wherein the first fixing base comprises a first pivotal extends towards the first position from the first fixing base and passes through the first axis hole of the first fixing element and the first through hole of the first passive rotating elements, such that the first fixing element and the first passive rotating elements are fixed on the first fixing base, and the first stopper of the first one of the first passive elements presses against the first the positioning flange of the first fixing element; and a second fixing base fixed at the first position on the sidewall of the lamp, wherein the first active rotating element is fixed on the second fixing base, the second fixing base has a first sleeve through which the first pivot passes and presses against the second axis hole of the first active rotating element, such that the first bump of the first active element presses against the second stopper of the N-th of the first passive elements.

8. The rotatable lamp according to claim 6, further comprising a second pivoting device for fixing the second fixing element, the second active rotating element and the second passive rotating elements, wherein the second pivoting device comprises:

a third fixing base fixed at the second corresponding portion of the frame, wherein the third fixing base comprises a second pivotal extends towards the second position from the third fixing base and passes through the third axis hole of the second fixing element and the second through hole of the second passive rotating elements, such that the third fixing element and the second passive rotating elements are fixed on the third fixing base, and the third stopper of the first one of the second passive elements presses against the second positioning flange of the second fixing element; and a fourth fixing base fixed at the second position on the sidewall of the lamp, wherein the second active rotating element is fixed on the fourth fixing base, the fourth fixing base has a second sleeve through which the second pivot passes and presses against the fourth axis hole of the second active rotating element, such that the second bump of the second active element presses against the fourth stopper of the M-th of the second passive rotating elements.

9. The rotatable lamp according to claim 5, wherein the rotation angle of the first active rotating element relative to the first fixing element is equal to a sum of relative rotation angles between the first fixing element, the first passive rotating elements and the first active rotating element.

10. The rotatable lamp according to claim 6, wherein the rotation angle of the second active rotating element relative to the second fixing element is equal to a sum of relative rotation angles between the second fixing element relative, the second passive rotating elements and the second active rotating element.

11. The rotatable lamp according to claim 4, wherein the frame is shaped as a polygon, a rectangle, a circle, or an ellipse.

* * * * *